US007267095B2

(12) United States Patent
Takahashi et al.

(10) Patent No.: US 7,267,095 B2
(45) Date of Patent: Sep. 11, 2007

(54) POWER UNIT HAVING CRANKCASE TO WHICH AUXILIARY MACHINE IS FITTED, AND MOTORCYCLE HAVING POWER UNIT

(75) Inventors: Isamu Takahashi, Saitama (JP); Yuichi Tawarada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/527,697

(22) Filed: Sep. 27, 2006

(65) Prior Publication Data

US 2007/0074699 A1 Apr. 5, 2007

(30) Foreign Application Priority Data

Sep. 30, 2005 (JP) ..... 2005-285801

(51) Int. Cl.
*F01M 1/02* (2006.01)
*F01P 5/10* (2006.01)
*F02B 61/04* (2006.01)

(52) U.S. Cl. ..... 123/198 R; 123/41.44; 123/196 R

(58) Field of Classification Search ..... 123/196 R, 123/198 R, 198 C, 41.44
See application file for complete search history.

(56) References Cited

U.S. PATENT DOCUMENTS 5,690,084 A * 11/1997 Gunji et al. ..... 123/572

FOREIGN PATENT DOCUMENTS

JP 2004-143952 A 5/2004

* cited by examiner

*Primary Examiner*—Noah P. Kamen
(74) *Attorney, Agent, or Firm*—Birch, Stewart, Kolasch & Birch, LLP

(57) ABSTRACT

An internal combustion engine in a power unit includes an oil pump that rotates by a transmission mechanism with an endless chain, and a crankcase with an opening formed by protruding walls of side walls of the crankcase in an axial direction. A drive sprocket is fitted to a main shaft of a gear transmission and a driven sprocket is fitted to a shaft end of a drive shaft of an oil pump. When viewed sideways, the protruding walls and mating faces have overlapping parts that partially overlap the driven sprocket. On the other hand, all the shaft end and the remainder of the driven sprocket are exposed inside the opening when the cover is removed. The resulting configuration improves the working efficiency in fitting an oil pump into the crankcase without reducing the rigidity of the crankcase.

20 Claims, 4 Drawing Sheets

POWER UNIT HAVING CRANKCASE TO WHICH AUXILIARY MACHINE IS FITTED, AND MOTORCYCLE HAVING POWER UNIT

CROSS-REFERENCE TO RELATED APPLICATION

The present application claims priority under 35 U.S.C. §119 to Japanese Patent Application No. 2005-285801, filed Sep. 30, 2005, the entire contents of which are hereby incorporated by reference.

BACKGROUND OF THE INVENTION

1. Field of the Invention

The present invention relates to a power unit with an internal combustion engine having an auxiliary machine rotated by a transmission mechanism and a crankcase which houses the transmission mechanism and the auxiliary machine and to which the auxiliary machine is fitted, and a motorcycle which has the power unit.

2. Description of Background Art

It has been known that an oil pump of an internal combustion engine is housed in a space formed by a crankcase (for example, see JP-A No. 2004-143952 ). In the case where the oil pump is rotated by a transmission mechanism with an endless chain, a driven sprocket with the endless chain wound around it is fitted to the drive shaft of the oil pump.

When the oil pump is fitted to the crankcase with the driven sprocket fitted to the drive shaft of the oil pump, first the endless chain wound around the drive sprocket should be wound around the driven sprocket and then, while keeping this condition, the oil pump should be fitted to the crankcase with bolts or the like, so oil pump fitting work is troublesome.

A method of making oil pump fitting work easier may be to fit the driven sprocket with the endless chain wound around it to the drive shaft of the oil pump through an opening made in the crankcase after fitting the oil pump to the crankcase. In this case, if all the driven sprocket is exposed inside the opening when viewed from the axial direction of the crank shaft, it would be easy to fit the driven sprocket to the drive shaft but the opening should be large enough, so the rigidity of the crankcase would deteriorate.

Furthermore, if the endless chain which drives the oil pump is wound around the drive sprocket which is fitted to the crank shaft, there should be space for the endless chain between the crank shaft and the oil pump drive shaft and thus the size of the crankcase should be large around the crank shaft and also the opening should be large, so the rigidity of the crankcase would deteriorate.

SUMMARY AND OBJECTS OF THE INVENTION

The present invention has been made in view of these circumstances an object to improve the working efficiency in fitting an auxiliary machine rotated by a transmission mechanism with an endless chain, to a crankcase and also suppress deterioration in the rigidity of the crankcase due to an opening made in a side wall of the crankcase and make the crankcase compact. Another object of the present invention is to make it possible to increase the banking angle and increase latitude in the arrangement of a vehicle body frame and an exhaust pipe by the shape of an opening formation area which forms the opening.

According to a first aspect of the present invention, a power unit includes an internal combustion engine including a crank shaft, a transmission mechanism with an endless chain wound around a drive sprocket and a driven sprocket, and an auxiliary machine which is rotated by the transmission mechanism. Also included are a crankcase, which houses the transmission mechanism, the auxiliary machine, and the crank shaft and to which the auxiliary machine is fitted. Further included are a crankcase cover which is, in order to cover an opening formed by an opening formation area as part of a side wall of the crankcase in an axial direction, joined to a mating face for the opening formation area and covers the opening; and a transmission which has an input shaft to which power of the crank shaft is transmitted.

In this power unit, the drive sprocket is fitted to the input shaft, the driven sprocket is fitted to a fitting part of a drive shaft of the auxiliary machine, and when viewed sideways, the opening formation area has an overlapping part overlapping the driven sprocket so as for the side wall to cover part of the driven sprocket, and all the fitting part and the rest of the driven sprocket are exposed inside the opening.

Accordingly, the driven sprocket with the endless chain wound around it can be inserted through the opening to the drive shaft of the auxiliary machine fitted to the crankcase. Also, since the opening formation area has an overlapping part so as for the side wall to cover part of the driven sprocket when viewed sideways, the opening can be smaller than in the case that the opening is provided in a way that all the driven sprocket is exposed inside the opening. Besides, since the endless chain does not surround the crankshaft, there is no need to provide space for the endless chain and a chain guide between the crank shaft and the drive shaft of the auxiliary machine.

According to a second aspect of the present invention, when viewed sideways, all or almost all part of the opening formation area that is located opposite to the input shaft with respect to the cylinder axis line is, than distance between a rotational centerline of the crankshaft located inside the opening and the driven sprocket, is nearer to the rotational centerline.

Accordingly, when viewed sideways, the opening formation area is located radially near the periphery of the crank shaft, opposite to the input shaft with respect to the cylinder axis line and the opening can be smaller.

According to a third aspect of the present invention, the input shaft is above the rotational centerline of the crank shaft, the auxiliary machine is below the rotational centerline, the overlapping part constitutes the lowest part of the opening formation area, and the crankcase cover covers the opening from the body width direction.

Accordingly, since the overlapping part constitutes the lowest part of the opening formation area, the lowest position of the crankcase cover located in the body width direction of the motorcycle is higher than in the case that the opening formation area surrounds all the driven sprocket.

Effect of the Invention

According to the first aspect of the present, the following effect is brought about. Since the driven sprocket can be fitted through the opening to the drive shaft after the auxiliary machine is fitted to the crankcase, the working efficiency in fitting the auxiliary machine to the crankcase is improved. In addition, since the opening formation area has an overlapping part, the opening made in the side wall is smaller and deterioration in the rigidity of the crankcase is suppressed. Also, since the endless chain does not surround the crank shaft, the size of the crankcase around the crank shaft is reduced.

According to the second aspect of the preset invention, the following effect is brought about. Since all or almost all the opening formation area which is opposite to the input shaft with respect to the cylinder axis line is radially near the periphery of the crank shaft, the crankcase can be smaller and the opening can be smaller, and deterioration in the rigidity of the crankcase is suppressed.

According to the third aspect of the present invention, the following effect is brought about. Since the lowest position of the crankcase cover located in the body width direction of the motorcycle is higher, the motorcycle's banking angle can be increased, and also the space under the crankcase cover is increased, making it possible to increase latitude in the arrangement of the exhaust pipe in the body frame by the use of this space.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
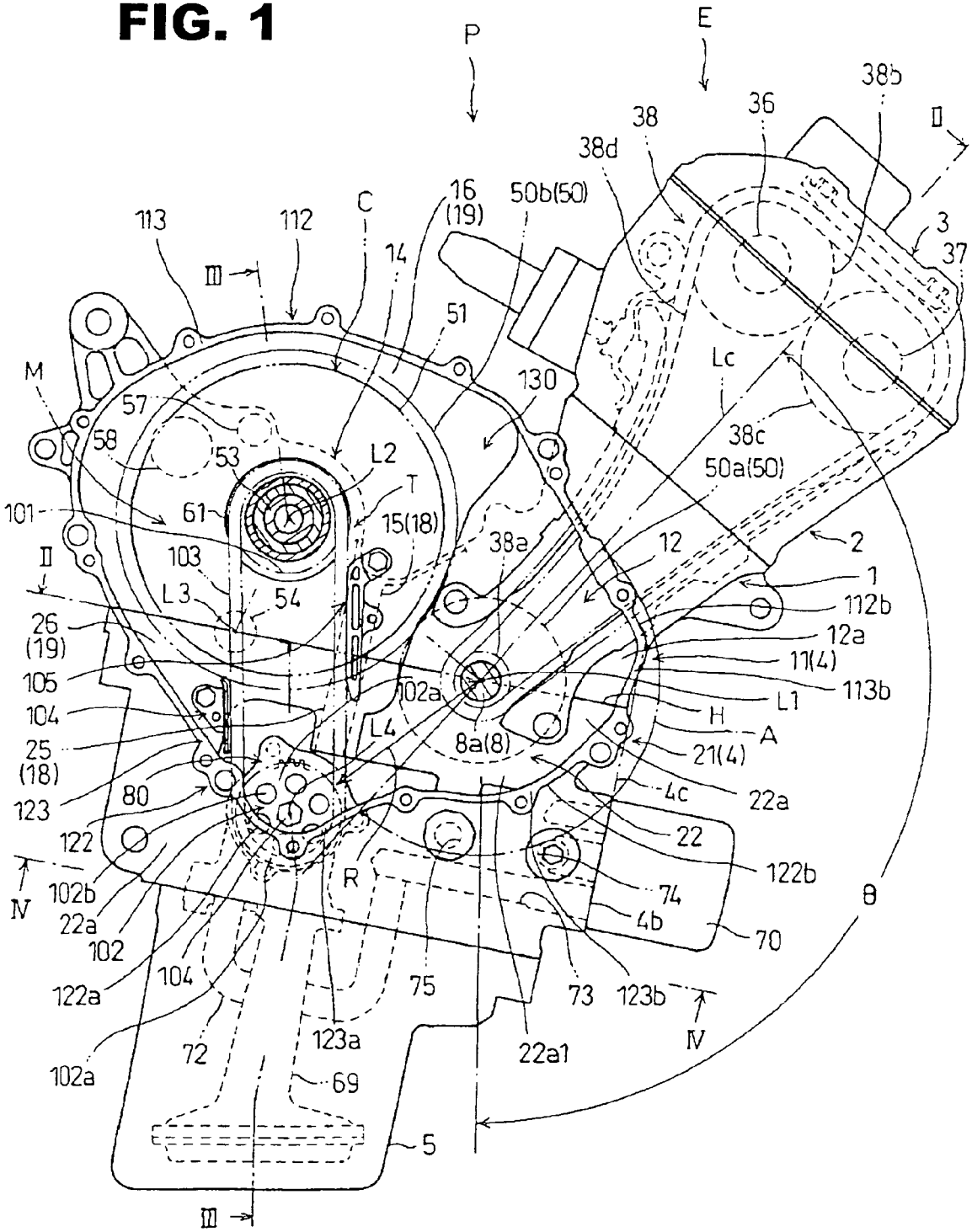
FIG. 1 is a right side sectional view showing part of a power unit, with a case cover removed, which has an internal combustion engine and a gear transmission having a transmission mechanism to which the present invention is applied, taken virtually along the line I-I in FIG. 2.
Figure 2:
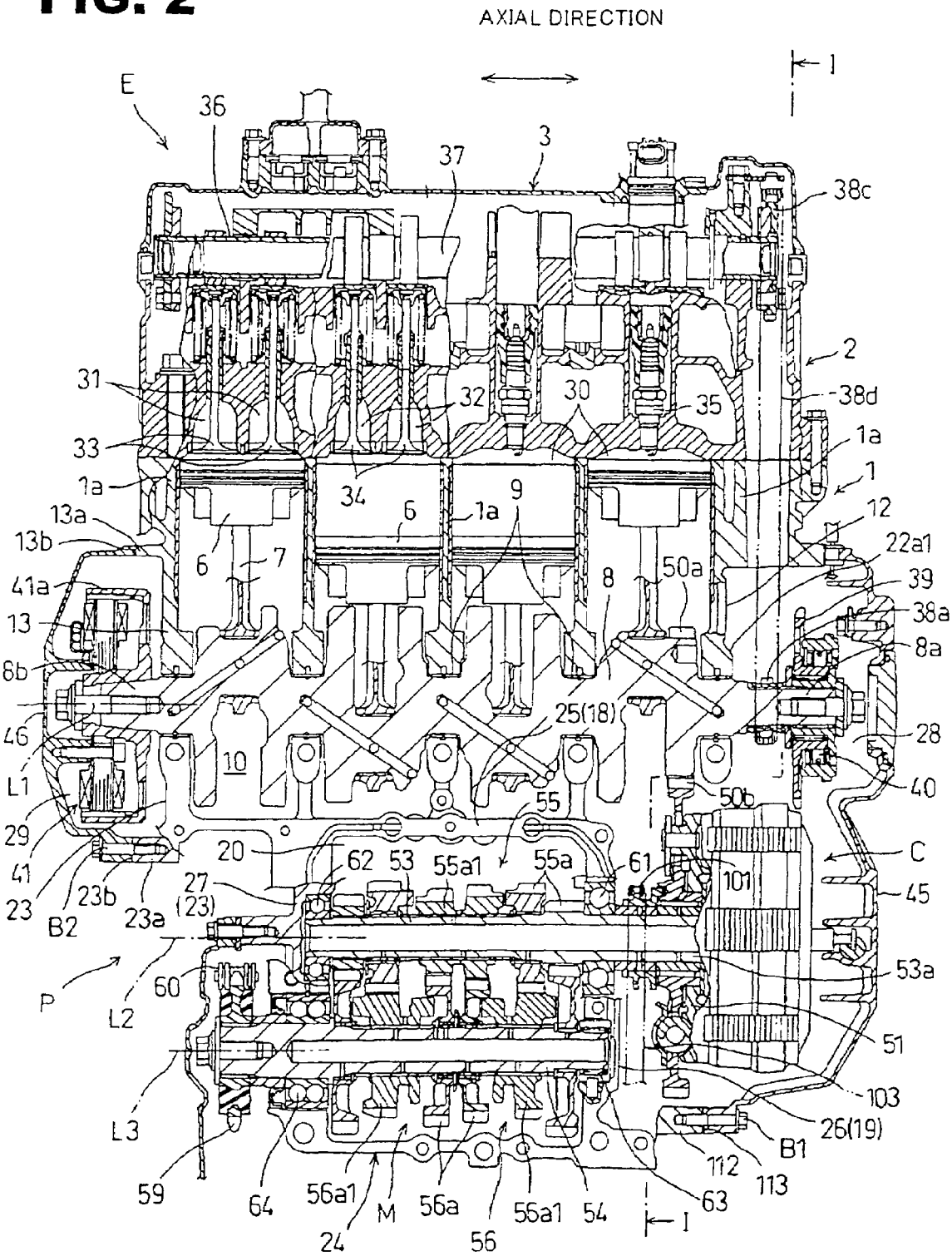
FIG. 2 is a sectional view taken virtually along the line II-II in FIG. 1.

Referring to FIGS. 1 and 2, a power unit P to which the present invention is applied is to be mounted on a motorcycle as a vehicle and includes a water-cooled multicylinder 4-stroke internal combustion engine E and a power transmission system which transmits power generated by the internal combustion engine E to a rear wheel as a driving wheel, and the power transmission system includes a multiple-disc friction clutch C as a clutch and a constant-mesh type gear transmission M as a transmission.

The internal combustion engine E, which is to be mounted on a motorcycle with a rotational centerline L1 of a crank shaft 8 transversely oriented and horizontal, has an engine body which includes: a cylinder block 1 as an integral molding of four cylinders 1*a* arranged serially, a cylinder head 2 joined to the top end of the cylinder block 1, a head cover 3 joined to the top end of the cylinder head 2, a lower crankcase 21 joined to the bottom end of the cylinder block 1, and an oil pan 5 joined to the bottom end of the lower In the specification and the claims, the axial direction means the direction parallel to the rotational centerline of the crank shaft and an expression "viewed sideways" means that something is "viewed from the axial direction." In embodiments, "front/rear or longitudinal", "upper/lower or vertical", and "left/right or transverse", denote "front/rear or longitudinal", "upper/lower or vertical", and "left/right or transverse" in a condition that the power unit P is mounted on a vehicle, and "right" denotes either one side or the other side in the axial direction and "left" denotes either one side or the other side in the axial direction.

A piston 6, which is reciprocally fitted into each cylinder 1*a*, is connected through a connecting rod 7 to a crank shaft 8. The crank shaft 8 is housed in a crank chamber 10 formed by a crankcase 4 as a combination of an upper crankcase 11 as a first crankcase and a lower crankcase 21 as a second crankcase which are constituted by a lower portion of the cylinder block 1, and is rotatably supported by the crankcase 4 through a main bearing 9 held between the upper crankcase 11 and the lower crankcase 21, and has a rotational centerline L1 on a separating plane H for the upper crankcase 11 and the lower crankcase 21.

Formed in the cylinder head 2 are, for each cylinder 1*a*, a combustion chamber 30 opposite to a piston 6 in a direction of extension of a cylinder axis line Lc, an intake port 31 which is open to the combustion chamber 30 and opened and closed by a pair of intake valves 33, and an exhaust port 32 which is opened and closed by a pair of exhaust valves 34; furthermore, an ignition plug 35, facing the combustion chamber 30, is attached to the cylinder head 2. Each intake valve 33 and each exhaust valve 34 are opened and closed synchronously with rotation of the crank shaft 8 by a DOHC valve system having an intake cam shaft 36 and an exhaust cam shaft 37 which are rotatably supported by the cylinder head 2. Therefore, the cam shafts 36, 37 are rotated at half the rotation speed of the crank shaft 8 by a valve system transmission mechanism 38 which is composed of a drive sprocket 38*a* provided at the right shaft end 8*a* of the crank shaft 8, cam sprockets 38*b*, 38*c* provided at the right shaft ends of the cam shafts 36, 37, and a timing chain 38*d* wound around the sprockets 38*a*, 38*b*, 38*c*.

A mixture of an air introduced by an intake device and fuel passes through the intake port 31 and enters each combustion chamber 30 when each intake valve 33 is open, where it is ignited by the ignition plug 35 and burns. The piston 6, driven and reciprocated by the pressure of combustion gas in the combustion chamber 30, rotates the crank shaft 8. The combustion gas flows into the exhaust port 32 as an exhaust gas when the exhaust valve 34 is open; then it is forced out by an exhaust device with an exhaust pipe connected to the exhaust port 32.

On the shaft end 8*a* protruding from the crank chamber 10 in the axial direction (which corresponds to the vehicle body width direction or transverse direction) are, from the crank chamber 10, the drive sprocket 38*a* and a one-way clutch 40 which transmits rotation of a starting driven gear 39 driven by a starter motor to the crank shaft 8. Protruding walls 112, 122 which are parts of right side walls 12, 22 of the upper crankcase 11 and lower crankcase 21 respectively and protrude in the axial direction are an opening formation area where an opening 130 surrounded by the protruding walls 112, 122 is formed and at the same time constitute a peripheral wall which surrounds the driven gear 39 and the clutch C. A right crankcase cover 45 which covers the opening 130 open right from the right side is joined, with many bolts B1, to mating faces 113, 123 as end faces of the protruding walls 112, 122 in the axial direction, and the crankcase cover 45 and the side walls 12, 22 make up a storage chamber 28 which houses the shaft end 8*a*, drive sprocket 38*a*, driven gear 39, clutch C, drive sprocket 101 and driven gear 50*b* and opens to the crank chamber 10.

On the other hand, a rotor 41*a* of an alternating-current dynamo 41 is provided on the left shaft end 8*b* of the crank shaft 8 protruding axially from the crank chamber 10. Protruding walls 13*a*, 23*a* which axially protrude on left side walls 13, 23 of the upper crankcase 11 and the lower crankcase 21 constitute a peripheral wall which surrounds the alternating-current dynamo 41; a dynamo cover 46 as a left crankcase cover is joined, with many bolts B2, to mating faces 13*b*, 23*b* as end faces of the protruding walls 13*a*, 23*a* in the axial direction and the dynamo cover 46 and the side walls 13, 23 make up a storage chamber 29 which houses the shaft end 8*b* and the alternating-current dynamo 41.

Figure 3:
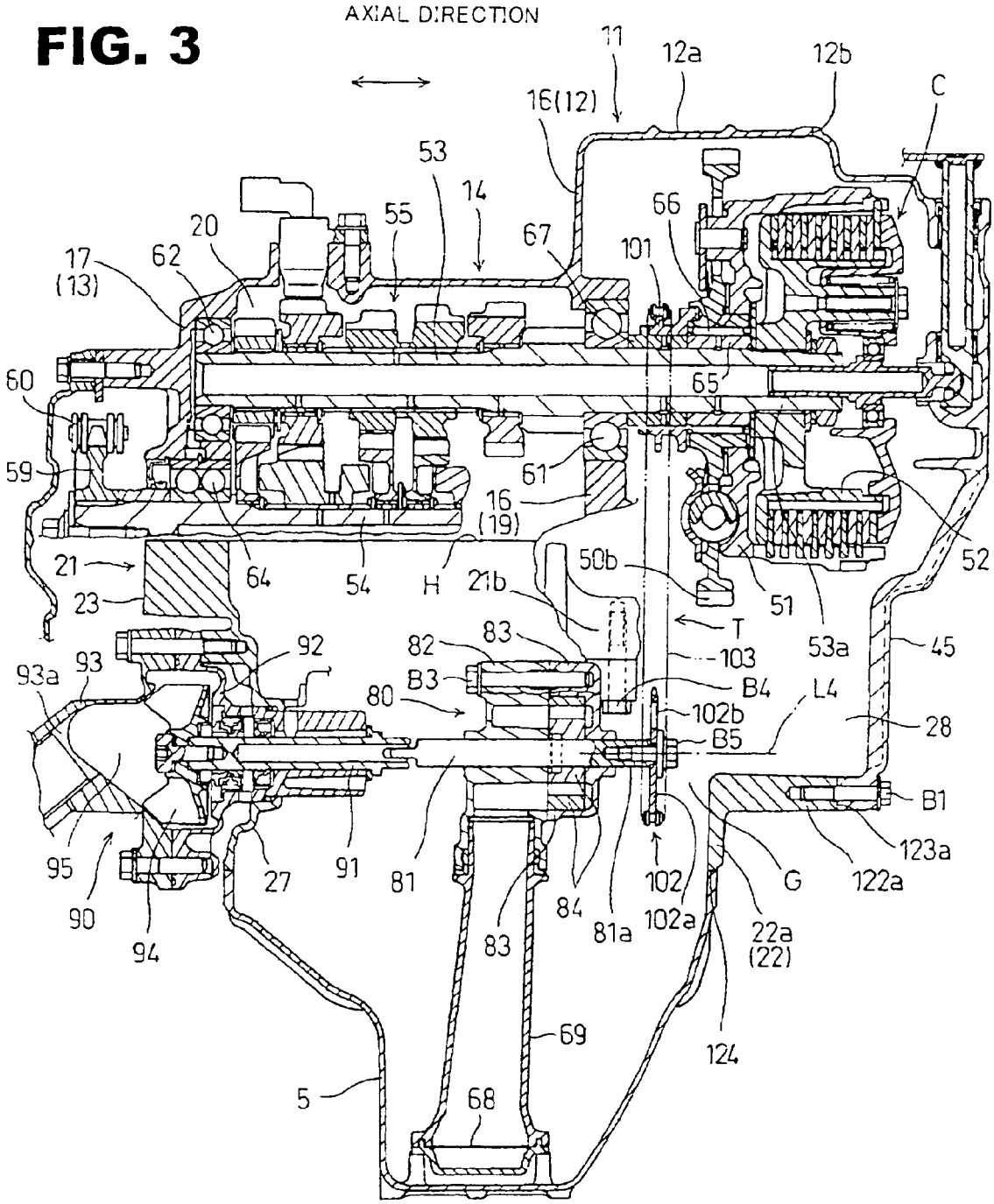
FIG. 3 is a sectional view taken virtually along the line III-III in FIG. 1.

Referring to FIG. 3 as well, power of the crank shaft 8 is transmitted through a primary reduction mechanism 50 to the clutch C and further from the clutch C to the gear transmission M. The primary reduction mechanism 50 includes a drive gear 50*a* integral with the crank shaft 8, and a driven gear 50*b* which engages with the drive gear 50*a* and is provided on a clutch outer 51 as an input member for the clutch C in a way to rotate together with it.

The gear transmission M includes: a main shaft 53 as an input shaft which is splined to a clutch inner 52 as an output member for the clutch C in a way to rotate together and to which a main shift gear train 55 is fitted; a counter shaft 54 as an output shaft to which a counter shift gear train 56 composed of a plurality of shift gears 56*a* engaging with a plurality of shift gears 55*a* constituting a shift gear train 55 and an output sprocket 59 as an output member are fitted; and a gear shift operation mechanism having a shift drum 58 which is operated and turned by a shift spindle 57 driven by a shift lever.

The gear shift operation mechanism has shifters 55*a*1, 56*a*1 which rotate together with the main shaft 53 or the counter shaft 54 and are made up of some of the shift gear 55*a* and the shift gear 56*a* where the shifters 55*a*1, 56*a*1 are moved in the axial direction through a shift fork (not shown) driven by the shift drum 58 which is activated in response to operation of the shift lever and in order to establish the desired gear ratio, connect the shift gear 55*a* and shift gear 56*a* engaging with each other so that they respectively rotate together with the main shaft 53 and the counter shaft 54.

The power of the crank shaft 8 after gear shift by the gear transmission M is transmitted to the rear wheel through a secondary reduction mechanism having a transmission chain 60 wound around an output sprocket 59 and the driven sprocket of the rear wheel.

The main shaft 53, the counter shaft 54 and both the shift gear trains 55, 56 are housed in a transmission chamber 20 which includes a transmission case composed of an upper transmission case 14 as a first transmission case including a rear part as part of the upper crankcase 11, and a lower transmission case 24 as a second transmission case including a rear part as part of the lower crankcase 21. Located behind the crank chamber 10, the transmission chamber 20 is isolated from the crank chamber 10 and the storage chamber 28 by a first partition wall 18 and a second partition wall 19 of the upper transmission case 14 and lower transmission case 24, and is open downward to the oil pan 5 like the crank chamber 10 and the storage chamber 28. Here, the first partition wall 18 includes protruding walls 15, 25 inside the crankcase 4 of the upper transmission case 14 and the lower transmission case 24; and the second partition wall 19 includes side walls 16, 26 (which include rear parts as parts of the side walls 12, 22) in the axial direction, of the upper transmission case 14 and the lower transmission case 24.

Therefore, the side wall 12 includes a first side wall 12*a* constituting a side wall of the crank camber 10, and a second side wall 16 located on the left of the first side wall 12*a*. Similarly, the side wall 22 includes a first side wall 22*a* including a side wall 22*a*1 of the crank camber 10, and a second side wall 26 located on the left of the first side wall 22*a*.

The first partition wall 18, stretching almost parallel to the axial direction, separates the transmission chamber 20 from the crank chamber 10 in a direction orthogonal to the axial direction (hereinafter called "orthogonal direction") and the second partition wall 19, stretching almost parallel to the orthogonal direction, separates the transmission chamber 20 from the crank chamber 10 and the storage chamber 28 in the axial direction.

The main shaft 53 is rotatably supported by the second partition wall 19 and the side wall 17 (part of the rear left side wall 13 of the upper crankcase 11) on the left of the upper transmission case 14 opposite to the second partition wall 19 in the axial direction through a pair of bearings 61, 62 respectively. The counter shaft 54 is rotatably supported by the second partition wall 19 and the side wall 17 of the upper transmission case 14 opposite to the second partition wall 19 in the axial direction and the side wall 27 of the lower transmission case 24 (part of the rear left side wall 23 of the lower crankcase 21) through a pair of bearings 63, 64 respectively.

Also, the main shaft 53 and the counter shaft 54 are parallel to each other and respectively have rotational centerlines L2 and L3 which are parallel to the rotational centerline L1. The rotational centerline L3 of the counter shaft 54 is on the separating plane H and the main shaft 53 is above the rotational centerline L1, the shaft ends 8*a*, 8*b* and the counter shaft 54.

From the transmission chamber 20 side, the drive sprocket 101, driven gear 50*b*, and clutch C, which transmits and shuts off power from the crank shaft 8 to the main shaft 53 are located coaxially with the shaft end 53*a* of the main shaft 53 which protrudes to the right from the transmission chamber 20 and stretches in the storage chamber 28. The driven gear 50*b*, which is joined to the clutch outer 51 in a way to rotate together, is rotatably supported by the main shaft 53 through a collar 65 supported by the shaft end 53*a* in a relatively rotatable manner, and a bearing 66 including a needle bearing provided on the periphery of the collar 65.

The drive sprocket 101, constituting a transmission mechanism T which rotates an oil pump 80 and a water pump 90 provided in the internal combustion engine E, is located between the side wall 16 (which is also the second partition wall 19 as a constituent of the upper transmission case 14) and the clutch C in the axial direction, and rotatably supported by the shaft end 53*a* through the collar 67 and further joined to the driven gear 50*b* by an integrally formed protrusion fitted into a hole of the driven gear 50*b* in a way to rotate together with the driven gear 50*b*.

Figure 4:
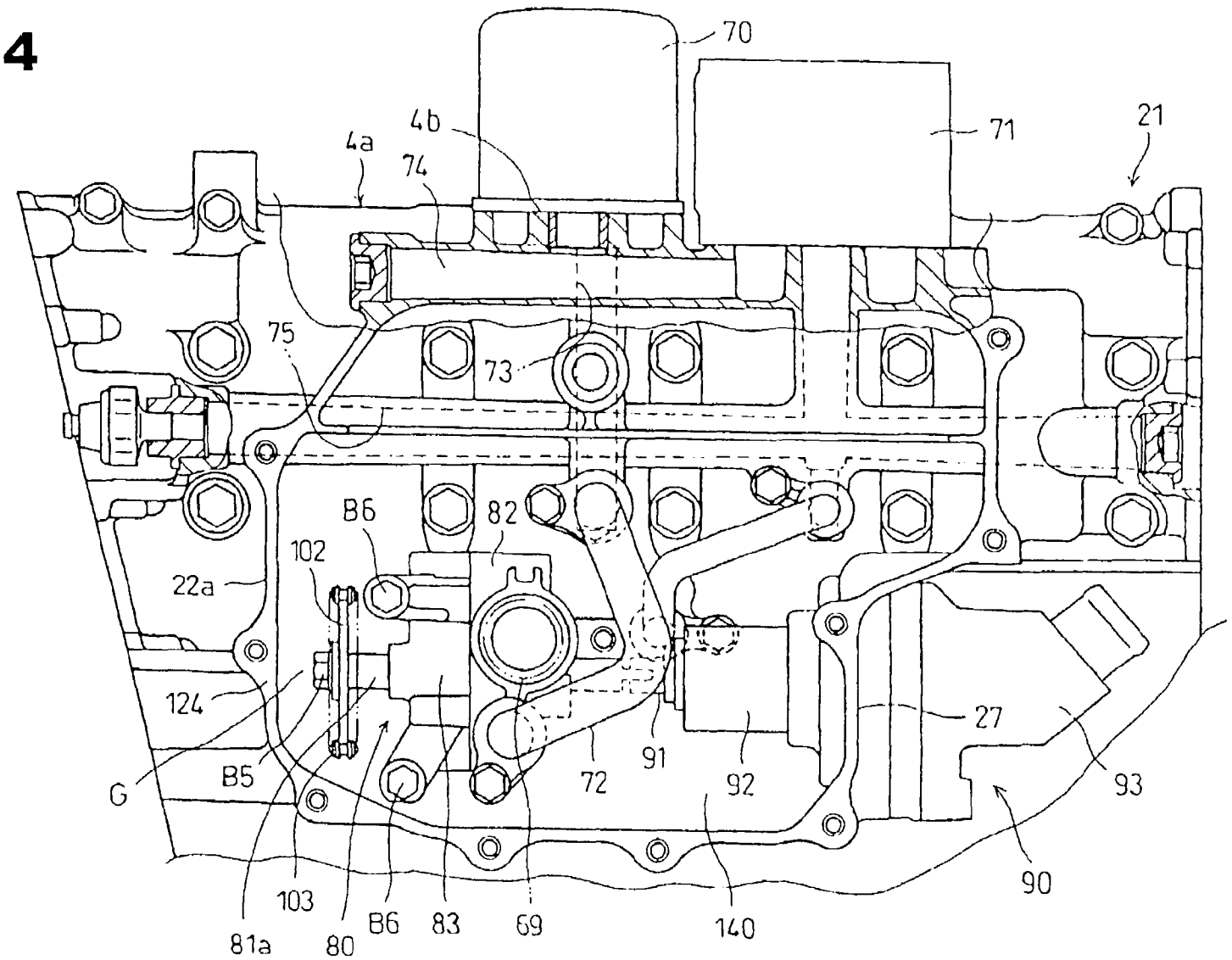
FIG. 4 is a view taken along the line IV-IV in FIG. 1.

Referring to FIGS. 1, 3 and 4, the lubrication system for the internal combustion engine E and the gear transmission M includes: an oil pan 5; an oil pump 80 which discharges lubricating oil taken from the oil pan 5 through a strainer 68 and a suction conduit 69; an oil filter 70 which cleans the discharged lubricating oil from the oil pump 80; a water-cooled oil cooler 71 which cools the lubricating oil which has passed through the oil filter 70; and many oil paths which lead the lubricating oil into required points including the lubricating points in the internal combustion engine E and the gear transmission M.

The oil pump 80 as an auxiliary machine for the internal combustion engine E includes: a drive shaft 81 which is rotated by power of the crankshaft 8 and includes a trochoid pump and has a rotational centerline L4 parallel to the rotational centerline L1; a pump body 82 with an intake port and a discharge port; and a pump cover 83 which houses a rotor 84 to be rotated by the drive shaft 81 and is joined to the pump body 82 with bolt B3. The oil pump 80 is fitted to the lower crankcase 21 by joining the pump cover 83 to the lower crankcase 21 with a plurality of bolts B4.

The lubricating oil taken through the oil strainer 68 and the suction conduit 69 from the oil pan 5 flows out of the oil pump 80, passes through a discharge conduit 72, then flows through an oil path 73 in the lower crankcase 21, into the oil filter 70. The lubricating oil which has passed through the oil filter 70 goes through an oil path 74 into an oil cooler 71; after passing through the oil cooler 71, it flows into a main gallery 75. After that, the lubricating oil in the main gallery 75 goes through the oil paths in the lower crankcase 21, cylinder block 1 and cylinder head 2 and is supplied to the lubricating points of the internal combustion engine E and the gear transmission M. The lubricating oil which has lubricated the lubricating points drops or flows down in the crank chamber 10, storage chamber 28 and transmission chamber 20 and returns into the oil pan 5.

The cooling system of the internal combustion engine E has a water pump 90 which is attached to a side wall 27 of the lower crankcase 21 and pressure-feeds cooling water. The water pump 90 as an auxiliary machine for the internal combustion engine E includes: a drive shaft 91 which is coaxial with the drive shaft 81 of the oil pump 80 and rotates together with it; a pump body 92 which is fitted into, and held by, the side wall 27 and also rotatably supports the drive shaft 91; a pump cover 93 which is joined to the pump body 92; and an impeller 94 which is rotated by the drive shaft 91.

Cooling water, the temperature of which has been lowered by heat release by a radiator, flows through an inlet port 93*a* of the pump cover 93 into the pump chamber 95 which includes the pump body 92 and the pump cover 93 and houses the impeller 94; then the cooling water pressure-fed by the impeller 94 flows out through an outlet port in the pump cover 93 and goes through a conduit to cooling water paths in the cylinder block 1 and the cylinder head 2.

The oil pump 80 and the water pump 90 are located just below the transmission chamber 20 and above the oil pan 5, and the oil pump 80, the water pump 90 and both the drive shafts 81, 91 are located below the rotational centerline L1, the crank chamber 10 and the transmission chamber 20. The main shaft 53 (therefore the rotational centerline L2) is located on one side of the separating plane H including the rotational centerlines L1, L3, namely above it, and the oil pump 80 and the water pump 90 are located on the other side, namely below it.

Referring to FIGS. 1, 3 and 4, the auxiliary machine transmission mechanism T which rotates the drive shaft 81 of the oil pump 80 and the drive shaft 91 of the water pump 90 includes: a drive sprocket 101; a driven sprocket 102 fitted to the drive shaft 81 in a way to rotate together with it; an endless chain 103 as an endless transmission belt wound around both the sprockets 101, 102; and as a pair of chain guides 104,105 which guide the endless chain 103 in contact with the periphery of the endless chain 103 to suppress vibration of the endless chain 103.

The driven sprocket 102, located in a lower portion of the storage chamber 28, is, by screwing a bolt B5 into the right shaft end 81*a* as a fitting part of the drive shaft 81 in the axial direction, joined and fitted to the shaft end 81*a*. The driven sprocket 102 has a web 102*a* with a plurality of through holes 102*b* spaced in the circumferential direction.

As shown in FIG. 1, when viewed from the right side, while the protruding wall 122 and mating face 123 have overlapping parts 122*a*, 123*a* which overlap the driven sprocket 102 so as for the side wall 22 to cover part of the driven sprocket 102, all the shaft end 8*a* of the crank shaft 8, all the shaft end 81*a* of the drive shaft 81, all the shaft end 53*a* of the main shaft 53, and the rest of the driven sprocket 102 are exposed inside the opening 130 or inside the protruding wall 122 and mating face 123.

More specifically, when viewed sideways, in the driven sprocket 102, all its portion below the overlapping parts 122*a*, 123*a* or all the portion outside the opening 130 with the rotational centerline L4 as the center is covered by the first side wall 22*a* from the right side. The overlapping parts 122*a*, 123*a* are located near the oil pan 5 or in a lower position in the driven sprocket 102 and constitute the lowest parts of the protruding wall 122 and mating face 123 respectively. In addition, between the first side wall 22*a* and protruding wall 122, and the shaft end 81*a*, there is space G in the axial direction where the driven sprocket 102 can be inserted through the opening 130 while the endless chain 103 wound around the drive sprocket 101 is wound around it.

Each through hole 102*b* of the web 102*a* is in such a position that it can intersect with the protruding wall 122 or mating face 123, when viewed sideways. When the driven sprocket 102 is fastened to the shaft end 81*a* by screwing bolt B5, a locking member including a bar member or tool (for example, a screwdriver) is axially inserted into any through hole 102*b* as an engaging part in a way to be able to touch the inner surface of the protruding wall 122 or the inner edge of the mating face 123 so that the drive shaft 81 is fitted into the driven sprocket 102 in a way to be locked against rotating on the driven sprocket 102 and unable to rotate in relation to it and thus the drive shaft 81 is prevented from rotating together with the bolt B5. This improves the working efficiency in fitting the driven sprocket 102 to the end shaft 81*a*.

The procedures of fitting the oil pump 80 to the lower crankcase 21 and fitting the driven sprocket 102 to the drive shaft 81 are briefly outlined below.

First, while the driven sprocket 102 is not fitted to the drive shaft 81, the oil pump 80 is inserted from near the mating face 124 into the lower crankcase 21 through an opening 140 surrounded by the mating face 124 for the oil pan 5 and joined to a fitting seat 21*b* of the lower crankcase 21 (see FIG. 3) with bolt B6. Then, before the crankcase cover 45 is joined to the mating faces 112, 122, the endless chain 103 wound around the drive sprocket 101 previously fitted to the main shaft 53 is wound around the driven sprocket 102 inserted in the lower crankcase 21 through the opening 130. Then, the driven sprocket 102 with the endless chain 103 around it is inserted into the space G and the bolt B5 is screwed into the shaft end 81*a* while the locking member inserted into, and engaged with, the through hole 102*b* is in contact with the inner surface of the protruding wall 122 or the edge of the mating face 123, so that the driven sprocket 102 is fastened to the shaft end 81*a*.

Referring to FIG. 1, when viewed sideways, among the protruding walls 112, 122 and mating faces 113, 123, all or almost all the protruding wall parts 112*b*, 122*b* and mating face parts 113*b*, 123*b*, which are located opposite to the main shaft 53 and drive shaft 81 with respect to the cylinder axis line Lc, are nearer to the rotational centerline L1 than distance R between the rotational centerline L1 of the crank shaft 8 and the driven sprocket 102 inside the opening 130 (an arc A with distance R as the radius and the rotational centerline L1 as the center is shown by chain double-dashed line in FIG. 1).

Therefore, the dimensions of the protruding walls 112, 122 and mating faces 113, 123 in the radial direction can be decreased around the shaft end 8*a* in a prescribed angle range θ with respect to the rotational centerline L1 as the center. The prescribed angle range θ is determined by the angle between a half line parallel to a line passing through both the rotational centerlines L2 and L4 of the main shaft 53 and drive shaft 81 when viewed sideways and stretching from the rotational centerline L1, and a half line of the cylinder axis line Lc stretching on the opposite side (cylinder head 2 side) of the oil pump 80 side from the rotational centerline L1.

On an external surface constituting the front of the crankcase 4 in the outer radial direction of the crank shaft 8 is a mounting surface 4*b* on which the oil filter 70 is to be mounted and the opening 130 as a whole is located nearer to the rotational centerline L1 than a plane 4*c* as an extension of the mounting surface 4*b*. Therefore, when viewed sideways, the amount of protrusion of the protruding walls 112, 122 and mating faces 113, 123 in a direction orthogonal to the mounting surface 4*b* or forward is smaller near the mounting surface 4*b* than near the crank shaft 8.

Next, the function and effect of the abovementioned embodiment will be described.

In the transmission mechanism T provided in the power unit P, the drive sprocket 101 is fitted to the main shaft 53, the driven sprocket 101 is fitted to the shaft end 81*a* of the drive shaft 81 of the oil pump 80, and when viewed sideways, the protruding walls 112, 122 and their mating faces 113, 123, which constitute the opening formation area, have overlapping parts 122*a*, 123*a* which overlap the driven sprocket 102 so as for the side wall 22 to cover part of the driven sprocket 102. On the other hand, all the shaft end 81*a* and the rest of the driven sprocket 102 are exposed inside the opening 130, so that after the oil pump 80 is fitted to the crankcase 4, the driven sprocket 102 with the endless chain 103 wound around it can be inserted through the opening 130 to the drive shaft 81 of the oil pump 80, thereby leading to improvement in the working efficiency in fitting the oil pump 80 to the crankcase 4.

Since, when viewed sideways, the protruding walls 112, 122 and their mating faces 113, 123 have the overlapping parts 122*a*, 123*a* so as for the side wall 22*a* to cover part of the driven sprocket 102, the opening 130 can be smaller than in the case that all the driven sprocket 102 is exposed inside the opening, and thus the opening 130 made in the side walls 12, 22 can be smaller and deterioration in the rigidity of the crankcase 4 can be suppressed. Furthermore, since the endless chain 103 does not surround the crank shaft 8, space for the endless chain and chain guide between the crank shaft 8 and the drive shaft 81 is not needed and thus the size of the crankcase 4 around the shaft end 8*a* of the crank shaft 8 can be reduced.

Since, when viewed sideways, all or almost all the protruding wall parts 112*b*, 122*b* and mating face parts 113*b*, 123*b*, which are located opposite to the main shaft 53 and drive shaft 81 with respect to the cylinder axis line Lc or both rotational centerlines L2, L4, are nearer to the rotational centerline L1 than distance R between the rotational centerline L1 of the crank shaft 8 and the driven sprocket 102 inside the opening 130, the protruding wall parts 112*b*, 122*b* and mating face parts 113*b*, 123*b* are adjacent to the periphery of the shaft end 8*a* in the radial direction on the opposite side of the main shaft 53 or the drive shaft 81 with respect to the cylinder axis line Lc and the opening 130 can be smaller. As a consequence, the crankcase 4 can be smaller and the opening can be smaller, so that deterioration in the rigidity of the crankcase 4 can be suppressed.

In addition, since the dimensions of the protruding wall parts 112*b*, 122*b* and mating face parts 113*b*, 123*b* in the radial direction can be decreased around the shaft end 8*a* in a prescribed angle range θ, the crankcase 4 can be smaller.

Furthermore, the mounting surface 4*b* on which the oil filter 70 is to be mounted is provided on the external surface 4*a* constituting the front of the crankcase 4 in the outer radial direction of crank shaft 8 and the opening 130 as a whole is located nearer to the rotational centerline L1 than the plane 4*c* as an extension of the mounting surface 4*b*. Therefore, the amount of protrusion of the protruding wall parts 112*b*, 122*b* and mating face parts 113*b*, 123*b* in a direction orthogonal to the mounting surface 4*b* or forward is smaller and thus the crankcase 4 can be smaller.

In a motorcycle, the main shaft 53 is located above the rotational centerline L1 of the crank shaft 8 and the oil pump 80 is located below the rotational centerline L1 and the overlapping parts 122*a*, 123*a* constitute the lowest parts of the protruding walls 112, 122 and mating faces 113, 123, and the crankcase cover 45 covers the opening 130 from the vehicle width direction and the overlapping parts 122*a*, 123*a* constitute the lowest parts of the mating faces 113, 123; therefore the lowest position of the crankcase cover 45 in the body width direction of the motorcycle can be higher than in the case that the protruding walls and mating faces surround all the driven sprocket 102 so that all the driven sprocket 102 is inside the opening, and therefore the lowest position of the crankcase cover 45 in the body width direction can be higher and the motorcycle's banking angle can be increased, and also the space under the crankcase cover 45 is increased, making it possible to increase latitude in the arrangement of the exhaust pipe in the body frame by the use of this space.

Furthermore, since the overlapping parts 122*a*, 123*a* in the driven sprocket 102 are near the oil pan 5, the oil pan 5 can be located near the oil pump 80 and the size of the internal combustion engine E can be reduced in the vertical direction.

Next, a partially modified version of the above embodiment will be described, focusing on the modified structure.

The transmission may be a gear transmission of a type other than the constant-mesh type or a transmission which is not a gear transmission.

It is also possible that the transmission mechanism T drives only one of the oil pump and the water pump. It is also possible that the auxiliary machine for the internal combustion engine is a device other than an oil pump and a water pump.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A power unit comprising:

an internal combustion engine including:

a crank shaft, a transmission mechanism with an endless chain wound around a drive sprocket and a driven sprocket, an auxiliary machine which is rotated by the transmission mechanism, a crankcase which houses the transmission mechanism, the auxiliary machine and the crank shaft, the auxiliary machine being fitted to the crankcase, and a crankcase cover adapted to cover an opening formed by an opening formation area as part of a side wall of the crankcase in an axial direction, the crankcase cover being joined to a mating face of the opening formation area, thereby covering the opening; and a transmission having an input shaft, power of the crank shaft being transmitted to the input shaft, wherein the drive sprocket is fitted to the input shaft, and the driven sprocket is fitted to a fitting part of a drive shaft of the auxiliary machine, and when viewed sideways, the opening formation area has an overlapping part overlapping a portion of the driven sprocket so that the side wall covers part of the driven sprocket, and wherein all of the fitting part and a non-overlapped portion of the driven sprocket are exposed inside the opening when viewed in the axial direction of the driven sprocket.

2. The power unit according to claim 1, wherein when viewed sideways, all or almost all parts of the opening formation area, which are located opposite to the input shaft with respect to the cylinder axis line Lc, are nearer to the rotational centerline L1 of the crank shaft than distance R between the rotational centerline L1 and the driven sprocket inside the opening.

3. A motorcycle having the power unit according to claim 1, wherein the input shaft is disposed above the rotational centerline L1 of the crank shaft, the auxiliary machine is disposed below the rotational centerline L1, the overlapping part constitutes a lowest part of the opening formation area, and the crankcase cover covers the opening from a body width direction.

4. A motorcycle having the power unit according to claim 2, wherein the input shaft is disposed above the rotational centerline L1 of the crank shaft, the auxiliary machine is disposed below the rotational centerline L1, the overlapping part constitutes a lowest part of the opening formation area, and the crankcase cover covers the opening from a body width direction.

5. The power unit according to claim 1, wherein the opening formation area includes a protruding wall and the mating face.

6. The power unit according to claim 5, wherein the protruding wall and the mating face overlap each other.

7. The power unit according to claim 1, wherein the auxiliary machine includes an oil pump.

8. The power unit according to claim 1, wherein the auxiliary machine and the crankcase cover are disposed on opposite sides of the driven sprocket.

9. The power unit according to claim 1, wherein the auxiliary machine includes a water pump.

10. The power unit according to claim 9, wherein the auxiliary machine includes an oil pump and a water pump arranged coaxially on one side of the driven sprocket.

11. A power unit comprising:

an internal combustion engine including:

a crank shaft, a transmission mechanism with an endless chain wound around a drive sprocket and a driven sprocket, an auxiliary machine which is rotated by the transmission mechanism, a crankcase adapted to house the transmission mechanism, the auxiliary machine and the crank shaft, the auxiliary machine being fitted to the crankcase, and a crankcase cover adapted to cover an opening formed by an opening formation area as part of a side wall of the crankcase in an axial direction, the crankcase cover being joined to a mating face of the opening formation area, thereby covering the opening; and a transmission having an input shaft disposed rearwardly of the crankshaft, power of the crank shaft being transmitted to the input shaft, wherein the drive sprocket is fitted to the input shaft, and the driven sprocket is fitted to a fitting part of a drive shaft of the auxiliary machine, and when viewed sideways, the opening formation area has an overlapping part overlapping a portion of the driven sprocket so that the side wall covers part of the driven sprocket, and wherein all of the fitting part and a non-overlapped portion of the driven sprocket are exposed inside the opening when the crankcase cover is removed.

12. The power unit according to claim 11, wherein when viewed sideways, substantially all parts of the opening formation area, which are located opposite to the input shaft with respect to the cylinder axis line Lc, are nearer to the rotational centerline L1 of the crank shaft than distance R between the rotational centerline L1 and the driven sprocket inside the opening.

13. A motorcycle having the power unit according to claim 11, wherein the input shaft is disposed above the rotational centerline L1 of the crank shaft, the auxiliary machine is disposed below the rotational centerline L1, the overlapping part constitutes a lowest part of the opening formation area, and the crankcase cover covers the opening from a body width direction.

14. A motorcycle having the power unit according to claim 12, wherein the input shaft is disposed above the rotational centerline L1 of the crank shaft, the auxiliary machine is disposed below the rotational centerline L1, the overlapping part constitutes a lowest part of the opening formation area, and the crankcase cover covers the opening from a body width direction.

15. The power unit according to claim 11, wherein the opening formation area includes a protruding wall and the mating face.

16. The power unit according to claim 15, wherein the protruding wall and the mating face overlap each other.

17. The power unit according to claim 11, wherein the auxiliary machine includes an oil pump and a water pump.

18. The power unit according to claim 11, wherein the auxiliary machine and the crankcase cover are disposed on opposite sides of the driven sprocket.

19. A power unit comprising:

an internal combustion engine including:

a crank shaft, a transmission mechanism with an endless chain wound around a drive sprocket and a driven sprocket, an auxiliary machine which is rotated by the transmission mechanism, a crankcase which houses the transmission mechanism, the auxiliary machine and the crank shaft, the auxiliary machine being fitted to the crankcase, and a crankcase cover adapted to cover an opening formed by an opening formation area on a protruding wall part of a side wall of the crankcase in an axial direction, the crankcase cover being joined to a mating face of the opening formation area, thereby covering the opening; and a transmission having a main shaft, power of the crank shaft being transmitted to the input shaft, wherein the drive sprocket is fitted to the input shaft, the driven sprocket is fitted to a fitting part of a drive shaft of the auxiliary machine, and when viewed sideways, the protruding wall part of the side wall overlaps a lower portion of the driven sprocket so that the side wall covers the lower portion of the driven sprocket, and wherein all of the fitting part and a non-overlapped portion of the driven sprocket are exposed inside the opening when viewed in the axial direction of the driven sprocket when viewed in the axial direction of the driven sprocket.

20. The power unit according to claim 19, wherein when viewed from a right side of the power unit, substantially all parts of the opening formation area, which are located opposite to the input shaft with respect to the cylinder axis line Lc, are nearer to the rotational centerline L1 of the crank shaft than distance R between the rotational centerline L1 and the driven sprocket inside the opening.

* * * * *